US006850202B2

(12) United States Patent
Watson

(10) Patent No.: US 6,850,202 B2
(45) Date of Patent: Feb. 1, 2005

(54) MOTORIZED ANTENNA POINTING DEVICE

(75) Inventor: P. Thomas Watson, Alpharetta, GA (US)

(73) Assignee: BellSouth Intellectual Property Corp., Wilmington, DE (US)

( * ) Notice: Subject to any disclaimer, the term of this patent is extended or adjusted under 35 U.S.C. 154(b) by 19 days.

(21) Appl. No.: 10/350,655

(22) Filed: Jan. 24, 2003

(65) Prior Publication Data

US 2003/0112194 A1 Jun. 19, 2003

Related U.S. Application Data

(63) Continuation of application No. 10/020,832, filed on Dec. 12, 2001, now Pat. No. 6,559,806, which is a continuation-in-part of application No. 09/751,284, filed on Dec. 29, 2000, now Pat. No. 6,480,161.

(51) Int. Cl.[7] ..... H01Q 3/00
(52) U.S. Cl. ..... 343/766
(58) Field of Search ..... 343/765, 757, 343/763, 878, 880, 882, 766

(56) References Cited

U.S. PATENT DOCUMENTS 110,434 A 12/1870 Clarke
2,575,917 A 11/1951 Johnson
2,611,566 A 9/1952 Landis
2,667,317 A 1/1954 Trebules
3,999,184 A * 12/1976 Fus, III ..... 343/709
4,126,865 A 11/1978 Longhurst et al.
4,237,465 A 12/1980 Shibano et al.
4,258,568 A 3/1981 Boetes et al.
4,495,706 A 1/1985 Kaminski
4,626,864 A 12/1986 Micklethwaite
4,691,207 A 9/1987 Timineri
4,726,259 A 2/1988 Idler
4,833,932 A 5/1989 Rogers (List continued on next page.)

*Primary Examiner*—Don Wong
*Assistant Examiner*—Minh Dieu A
(74) *Attorney, Agent, or Firm*—Withers & Keys, LLC

(57) ABSTRACT

Portable devices and associated methods for orienting a receiver that is supported on a mast by a mounting bracket in a desired orientation. In one embodiment, the portable device includes an actuator that is removably coupled to the mounting bracket and, upon actuation thereof, rotates the mounting bracket and the receiver about the mast to the desired orientation and, upon deactivation thereof, may be decoupled from the mounting bracket while the mounting bracket retains the receiver in the desired orientation.

10 Claims, 11 Drawing Sheets

U.S. PATENT DOCUMENTS 5,065,969 A 11/1991 McLean
5,138,651 A 8/1992 Sudo
5,276,972 A 1/1994 Staney
5,351,060 A 9/1994 Bayne
5,469,182 A 11/1995 Chaffee
5,473,335 A 12/1995 Tines
5,561,433 A 10/1996 Chaney et al.
5,646,638 A 7/1997 Winegard et al.
5,647,134 A 7/1997 Chou
5,657,031 A 8/1997 Anderson et al.
5,734,356 A 3/1998 Chang
5,760,739 A 6/1998 Pauli
5,764,186 A 6/1998 Yoo
5,829,121 A 11/1998 Shoemaker et al.
5,870,059 A 2/1999 Reynolds
5,894,674 A 4/1999 Feldman
5,903,237 A 5/1999 Crosby et al.
5,920,291 A 7/1999 Bosley
5,945,945 A 8/1999 Wagner et al.
5,977,922 A 11/1999 Hemmingsen, II
5,992,809 A 11/1999 Sweere et al.
5,999,139 A 12/1999 Benjamin et al.
6,008,769 A 12/1999 Palmiter et al.
6,023,247 A 2/2000 Rodeffer
6,031,508 A 2/2000 Ishizuka et al.
6,037,913 A * 3/2000 Johnson ..... 343/882
6,097,344 A * 8/2000 Anderson ..... 343/709
6,208,314 B1 3/2001 Bourquin
6,229,480 B1 5/2001 Shintani
6,262,687 B1 7/2001 Bai et al.
6,285,338 B1 9/2001 Bai et al.
6,331,839 B1 12/2001 Grenell
D453,151 S 1/2002 Weaver
D453,330 S 2/2002 Weaver
6,480,161 B2 * 11/2002 Watson ..... 343/766
6,484,456 B1 * 11/2002 Featherstone et al. ..... 52/118
6,484,987 B2 11/2002 Weaver
6,486,851 B2 11/2002 Weaver
6,507,325 B2 1/2003 Matz et al.
6,559,806 B1 * 5/2003 Watson ..... 343/766
6,580,391 B1 6/2003 Kepley et al.
6,683,581 B2 1/2004 Matz et al.
2002/0083573 A1 7/2002 Matz et al.
2002/0083574 A1 7/2002 Matz et al.
2002/0084941 A1 7/2002 Matz et al.
2002/0084946 A1 7/2002 Matz et al.

* cited by examiner

MOTORIZED ANTENNA POINTING DEVICE

CROSS-REFERENCE TO RELATED APPLICATIONS

This is a continuation of U.S. patent application Ser. No. 10/020,832 filed Dec. 12, 2001 now U.S. Pat. No. 6,559,806, which is a continuation-in-part of U.S. patent application Ser. No. 09/751,284, filed Dec. 29, 2000, now U.S. Pat. No. 6,480,161.

BACKGROUND OF THE INVENTION

1. Field of the Invention

The subject invention relates to alignment devices and, more particularly, to devices for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworkykin invented the iconoscope, a device that permitted pictures to be electronically broken down into hundreds of thousands of components for transmission, and the kinescope, a television signal receiver, did the concept of television become a reality. Zworkykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or mast located in the subscriber's yard. A typical antenna constructed to receive satellite signals comprises a dish-shaped receiver that has a support arm protruding outward from the front surface of the dish. The support arm supports a low noise block amplifier with an integrated feed "LNBF". The dish collects and focuses the satellite signal onto the LNBF which is connected, via cable, to the subscriber's set top box.

To obtain an optimum signal, the antenna must be installed such that the centerline axis of the dish, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed.

The ability to quickly and accurately align the centerline axis of antenna with a satellite is somewhat dependent upon the type of mounting arrangement employed to support the antenna and the skill of the installer. Prior antenna mounting arrangements typically comprise a mounting bracket that is directly affixed to the rear surface of the dish. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket.

In an effort to automate the adjustment and positioning of an antenna, several different permanent motorized antenna mounts have been designed. For example, U.S. Pat. No. 4,726,259 to Idler, U.S. Pat. No. 4,626,864 to Micklethwaite, and U.S. Pat. No. 5,469,182 to Chaffe disclose different motorized antenna positioners that are designed to be permanently affixed to an antenna. Those devices are not designed such that they can be used to orient an antenna and then removed therefrom in order that they can be used to orient another antenna.

Thus, there is a need for a portable antenna alignment device that can be attached to antenna to automatically position the antenna in a desired orientation and removed therefrom to enable the device to be used to position other antennas.

SUMMARY OF THE INVENTION

In accordance with one form of the present invention, there is provided a portable device for orienting a receiver that is supported on a mast by a mounting bracket that selectively permits the receiver to be pivoted to a desired elevation angle and thereafter retained at the desired elevation angle. In one embodiment, the portable device comprises an elevation actuator removably coupled to the receiver and mast and, upon actuation thereof, pivots the receiver to the desired elevation angle and, upon deactivation thereof, maybe decoupled from the mast and receiver while the mounting bracket retains the receiver in the desired elevation angle.

Another embodiment of the present invention comprises a portable device for orienting a receiver that is supported by a mounting bracket that selectively permits the receiver to be pivoted to a desired elevation angle and thereafter retained at the desired elevation angle. One embodiment comprises means for generating rotary motion and means for coupling the means for generating rotary motion to the receiver. This embodiment may also comprise means for controlling the means for generating rotary motion such that, upon actuation of the means for generating rotary motion, the means for coupling pivots the receiver to the desired elevation angle and, upon deactivation of the means for generating rotary motion, the means for generating maybe decoupled from the receiver while the mounting bracket retains the receiver in the desired elevation angle.

Another embodiment of the present invention comprises a method for orienting a receiver at a desired elevation angle and may include coupling an elevation actuator to the receiver and actuating the elevation actuator to pivot the receiver to the desired elevation angle. This method may further include retaining the receiver at the desired elevation angle and decoupling the elevation actuator from the receiver.

Another embodiment of the present invention comprises a method for orienting a receiver that is supported by a mounting bracket that selectively permits the receiver to be pivoted to a desired elevation angle and thereafter retained at the desired elevation angle. One embodiment of this method may comprise coupling an elevation actuator to the receiver and loosening the mounting bracket to permit the receiver to pivot about an elevation pivot axis. The method may also include actuating the elevation actuator to pivot the receiver about the elevation pivot axis and deactivating the elevation actuator when the receiver has been pivoted to the desired elevation angle. This embodiment may further include locking the mounting bracket to retain the receiver in the desired elevation angle and detaching the elevation actuator from the receiver.

Yet another embodiment of the present invention may comprise a portable device for orienting a receiver that is supported on a mast by a mounting bracket that selectively permits the receiver to be rotated about the mast to a desired orientation and selectively permits the receiver to be pivoted relative to the mounting bracket to a desired elevation angle and thereafter retained in the desired orientation and elevation angle. One embodiment of this device may comprise an azimuth actuator assembly removably coupled to the receiver and mast, such that upon actuation thereof, said azimuth actuator rotates the mounting bracket and receiver about the mast and, upon deactivation thereof may be decoupled from the mounting bracket and mast while the mounting bracket retains the receiver in the desired orientation. This embodiment may also include an elevation actuator removably coupled to the receiver such that, upon actuation thereof, said elevation actuator pivots the receiver to the desired elevation angle and, upon deactivation thereof, maybe decoupled from the mast and receiver while the mounting bracket retains the receiver in the desired elevation angle.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
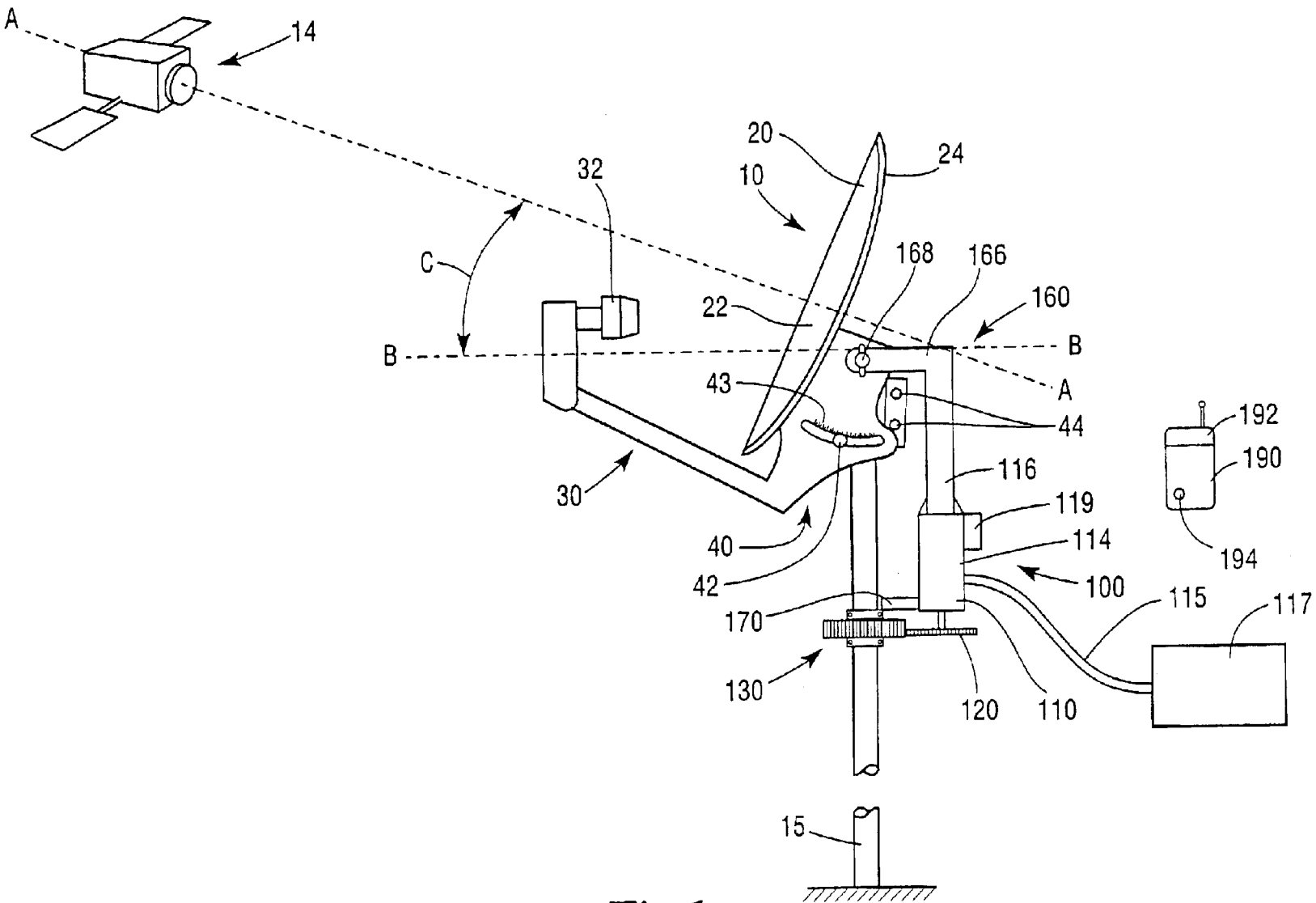
FIG. 1 is a side elevational view of one embodiment of the antenna alignment device of the present invention attached to a conventional antenna that is mounted to a mast to receive a signal from a satellite.

Referring now to the drawings for the purposes of illustrating embodiments of the invention only and not for the purposes of limiting the same, FIG. 1 illustrates a conventional antenna or receiver 10 that is supported by a vertically extending antenna mast 15. The mast 15 is mounted in the earth or attached to a structure (building, tree, etc.) such that it is plumb. Those of ordinary skill in the art will appreciate that various conventional methods exist for ensuring that the mast 15 is "plumb". For example, a convention level or plumb bob could be used.

In this embodiment, the antenna 10 includes parabolic dish 20 and an arm assembly 30 that supports a LNBF 32 for collecting focused signals from the dish 20. Such LNBFs are known in the art and, therefore, the manufacture and operation of LNBF 32 will not be discussed herein. The dish 20 has a front surface 22 and a rear surface 24. A conventional mounting bracket assembly 40 is attached to the rear surface 24 of the dish and serves to adjustably support the antenna on the mast 15.

Antenna 10 must be properly positioned to receive the television signals transmitted by a satellite 14 to provide optimal image and audible responses. See FIGS. 1 and 2. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIG. 1, the antenna's elevation is adjusted by loosening the an elevation adjustment bolt 42 and pivoting the antenna dish 20 to the desired elevation about an elevation pivot axis D—D defined by the mounting bracket 40. See FIG. 3. Thereafter, the elevation adjustment bolt 42 is tightened to retain the antenna dish 20 in that orientation. To assist the installer in determining the proper elevation setting, a plurality of reference marks 43 are commonly provided on the mounting bracket. See FIG. 1.

Figure 2:
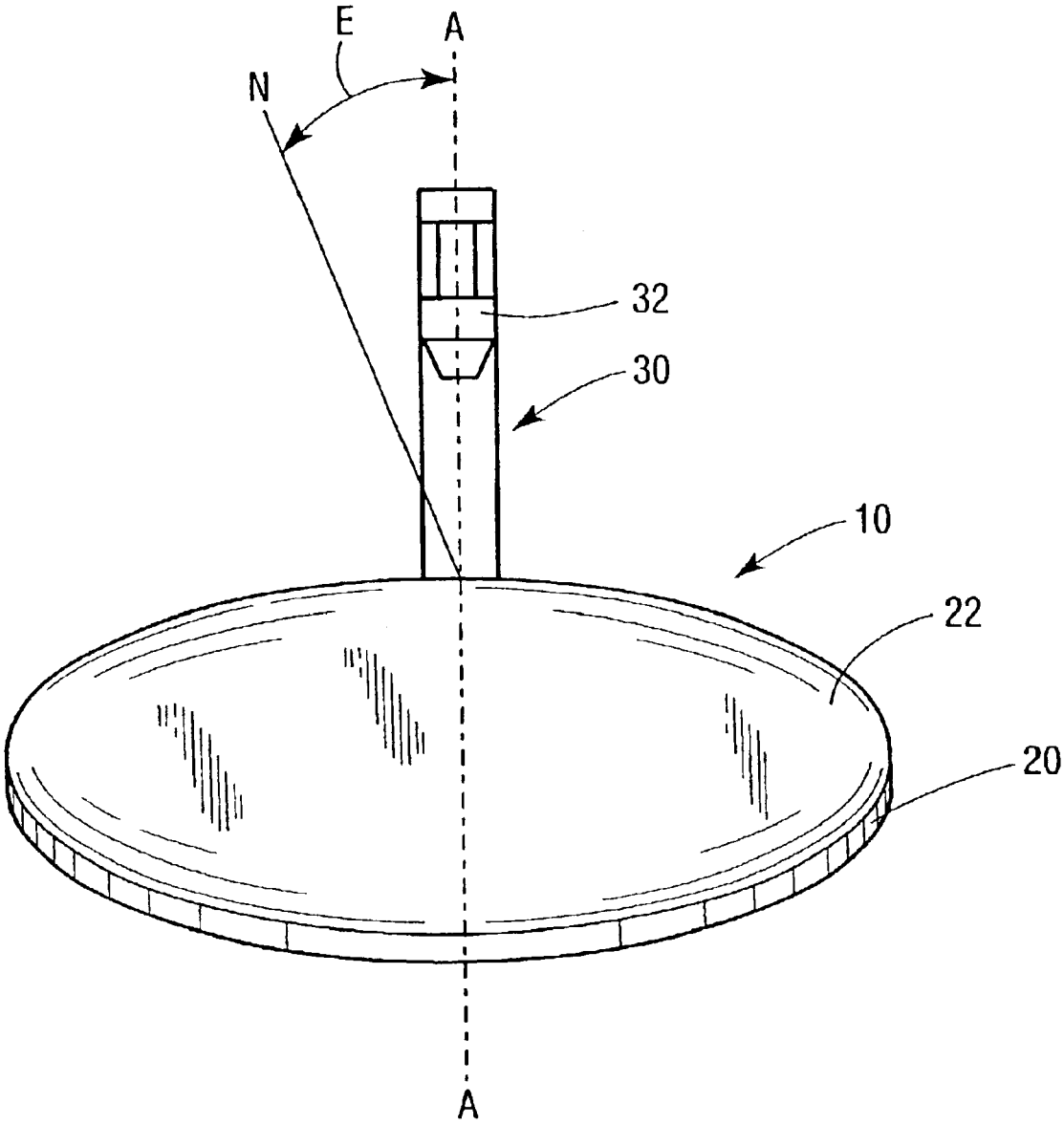
FIG. 2 is a top view of the antenna of FIG. 1.

As shown in FIG. 2, "azimuth" refers to the angle of axis A—A relative to the direction of magnetic north in a horizontal plane. That angle is generally designated as angle "E" in FIG. 2. To adjust the azimuth of the antenna 10, the mounting bracket assembly 40 is equipped with an azimuth locking members in the form of azimuth adjustment bolts 44. Azimuth adjustment bolts 44 are loosened and the antenna dish 20 is pivoted about the mast 15 until the desired azimuth orientation has been achieved. The azimuth adjustment bolts 44 are then retightened. A variety of different methods of determining the azimuth of the antenna have been developed. For example, the installer may support a conventional compass above or below the support arm and then align the support arm along the proper heading. An apparatus that employs a compass and an inclinometer for aligning a dish is disclosed in U.S. Pat. No. 5,977,992 and may be used to accomplish that task.

Figure 5:
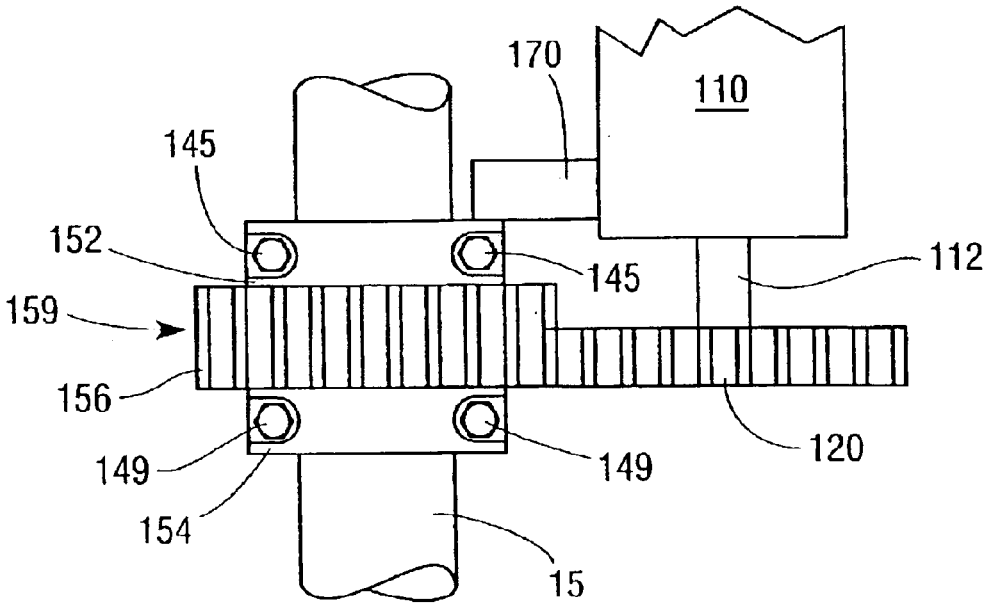
FIG. 5 is a partial view of antenna alignment device of the present invention coupled to antenna mast.
Figure 6:
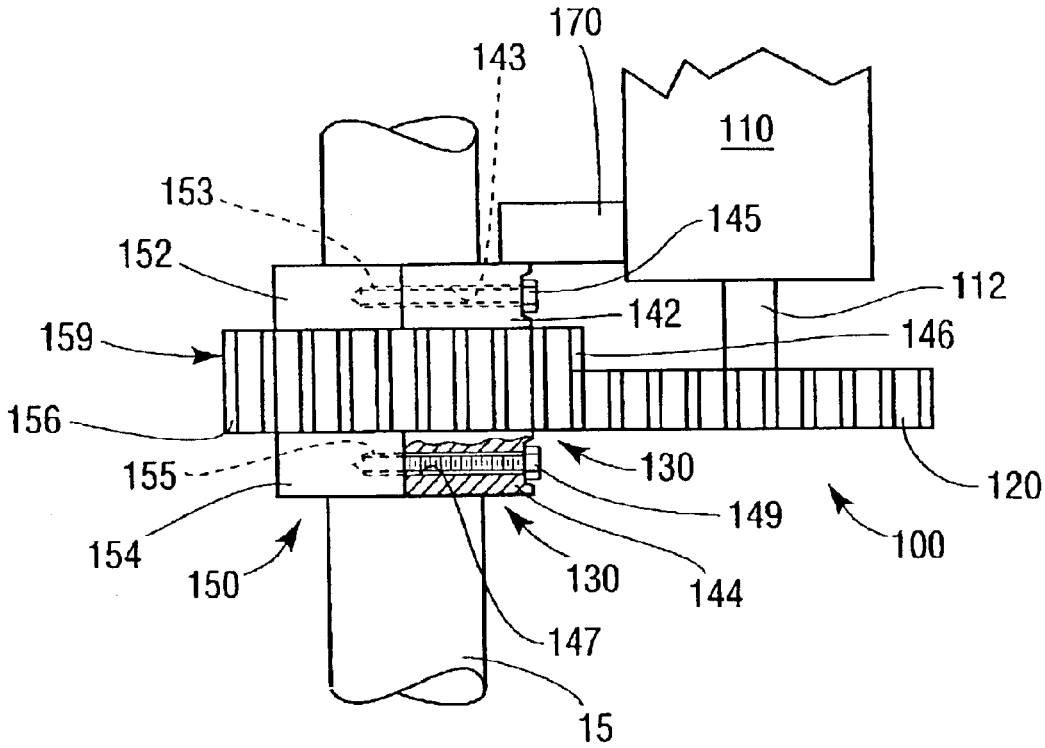
FIG. 6 is another partial view of the antenna alignment device of FIG. 5.

The motorized antenna alignment device 100 of the present invention may be employed to align the antenna 10 in a desired azimuth orientation. More specifically and with reference to FIGS. 1 and 3–6, one embodiment of the motorized antenna alignment device 100 includes a conventional motor 110. Motor 110 has a driven shaft 112 to which a driver gear 120 is non-rotatably affixed. Driver gear 120 is adapted to intermesh with the gear assembly 130 attached to the mast 15. Gear assembly 130 comprises a split collar assembly that is adapted to be removably affixed to the mast 15. As can be seen in FIGS. 1, 5 and 6, the gear assembly 130 includes a first gear assembly 140 and a second gear assembly 150. The first gear assembly 140 includes first and second collar portions (142, 144) and a first gear segment 146. Similarly, the second gear assembly 150 includes a primary collar portion 152, a secondary collar portion 154 and a second gear segment 156. The first collar portion 142 has a pair of holes hole 143 therethrough that are adapted to be coaxially aligned with a pair of threaded bores 153 in the primary collar portion 152. First clamping bolts 145 are inserted through holes 143 to be threadedly received in threaded bores 153. Likewise, the second collar portion 144 has a pair of holes 147 therethrough that are adapted to be coaxially aligned with a pair of threaded bores 155 in the secondary collar portion 154. Second clamping bolts 149 are inserted through holes 147 to be threadedly received in threaded holes in the secondary collar portion 154. See FIGS. 5 and 6. When clamped to the mast 15 as shown in FIGS. 5 and 6, the first gear segment 146 and the second gear segment 156 form a driven gear 159.

Figure 1A:
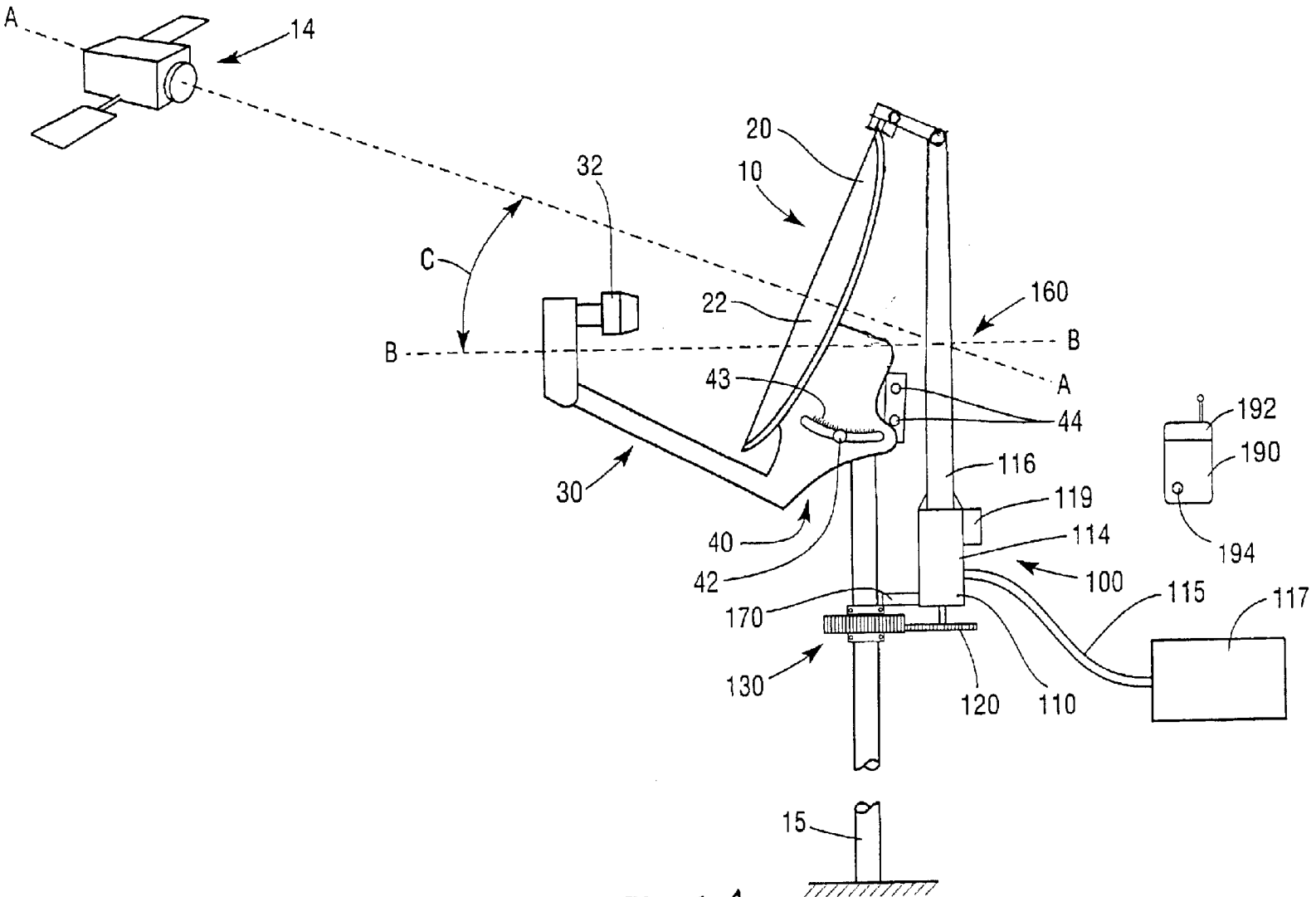
FIG. 1A is a side elevational view of another embodiment of an antenna alignment device of the present invention attached to a conventional antenna that is mounted to a structure.
Figure 3:
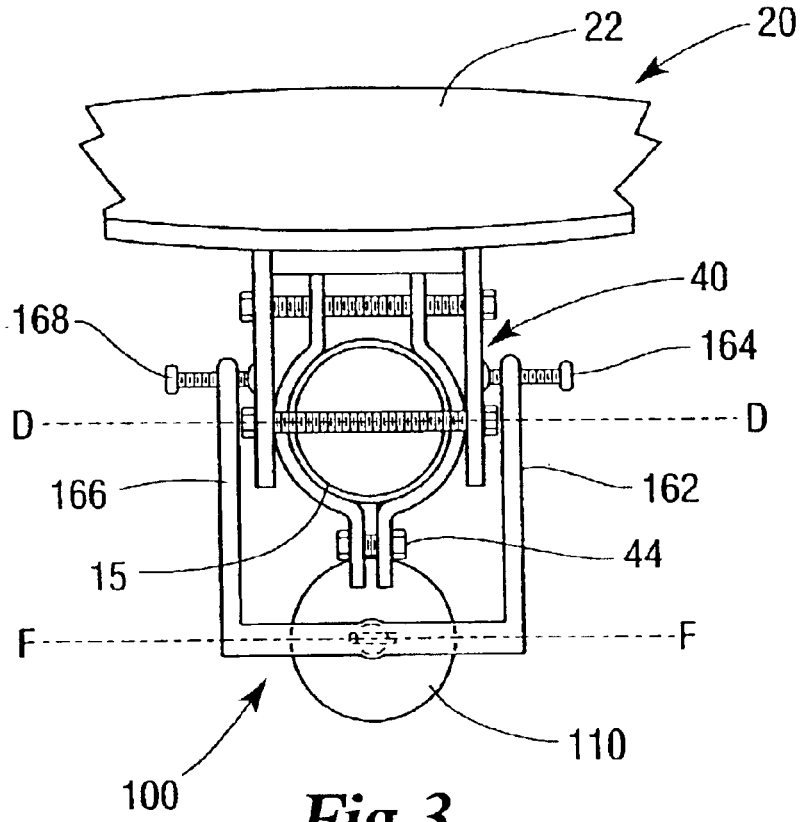
FIG. 3 is a top of view of the antenna alignment device and antenna depicted in FIG. 1.
Figure 4:
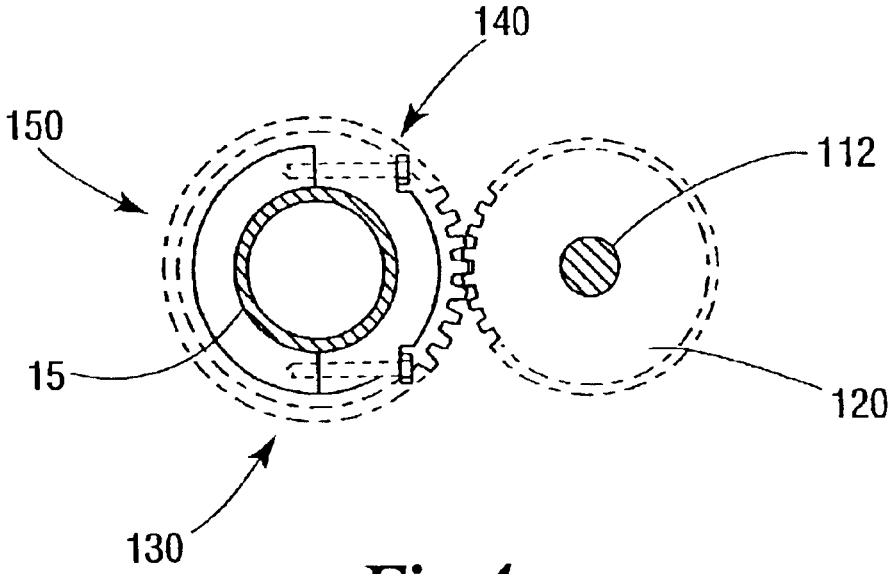
FIG. 4 is a partial view of a driver gear and a gear assembly of the antenna alignment device of FIGS. 1 and 3.

The motorized antenna alignment device 100 of this embodiment further includes a clamping arm assembly 160 that serves to clamp onto the mounting bracket assembly 40. As can be seen in FIG. 1, the clamping assembly 160 is rigidly attached to the housing 114 of the motor 114 by a vertically extending support member 116 that is attached to the motor housing 112 by, for example, screws or other fasteners (not shown). The clamping assembly 160 may be pivotally pinned to the vertical support member for pivotal travel about an axis F—F. See FIG. 3. The clamping assembly 160 includes a first clamping arm 162 and a second clamping arm 166. A first thumbscrew 164 is threaded through the first clamping arm 162 as shown in FIG. 3. A second thumbscrew 168 is threaded into the second clamping arm 166. The clamping assembly 160 may be clamped onto the mounting bracket assembly 40 by threading the first and second clamping screws (164, 168) into engagement with the mounting bracket assembly 40. Also in this embodiment, to provide support to the motor 110 when the alignment assembly 100 is affixed to the mast 15 and mounting bracket assembly 40 as shown in FIG. 1, a lower support member 170 is attached to the lower end of the motor housing 112. The lower support member 170 is adapted to slide around the top surfaces of the first and primary collar portions (142, 152). Those of ordinary skill in the art will appreciate that the motor 110 could be attached to other portions of the antenna utilizing other types of fastener arrangements without departing from the sprit and scope of the present invention. For example, the motor 110 could conceivably be attached or clamped to a portion of the antenna dish 20 as opposed to being clamped to a portion of the mounting bracket assembly 40. See FIG. 1A.

In this embodiment, the motor 110 may receive power from a source of alternating current 116 through cord 115. However, it is conceivable that motor 110 may comprise a DC powered stepper motor that is powered by a battery or batteries. Motor 110 may be controlled by a remote control hand held unit 190 that sends control signals to motor controls 119. Hand held unit 190 may be equipped with a conventional GPS unit 192 to enable the user to determine the longitude and latitude of the installation location. In addition, the hand held unit 190 may be equipped with a compass 194 that may be used to determine the azimuth orientation of the antenna 10.

This embodiment of the antenna alignment device 100 of the present invention may be used in the following manner. The installer clamps the clamping assembly 160 onto the mounting bracket assembly 40 by turning the first and second clamping screws (164, 168) into clamping engagement with the mounting bracket assembly 40. Thereafter, the gear assembly 130 is clamped onto the mast 15 with the clamping screws (145, 149) to attach it to the mast 15 as shown in FIGS. 5 and 6. As can be seen in FIG. 6, the driven gear 159 of the gear assembly 130 is in meshing engagement with the driver gear 120 and the lower support member 170 is supported on the collar portion 142. After the alignment device 100 is affixed to the mast 15 and mounting bracket assembly 40 as shown in FIGS. 1 and 3, the azimuth locking bolts 44 on the mounting bracket assembly 40 are loosened. The motor 110 is then powered to rotate the driver gear 120 about the driven gear 159 of the gear assembly 130 and cause the entire antenna 10 to rotate about the mast 15. Once the installer determines that the antenna 10 has been moved to the desired azimuth orientation utilizing conventional alignment methods and techniques, the motor 110 is stopped and the azimuth locking bolts 44 are locked in position. Thereafter, the alignment device 100 is unclamped from the mounting bracket assembly 40 and the gear assembly 130 is removed from the mast 15 to enable those devices to be used to align other antennas.

Figure 7:
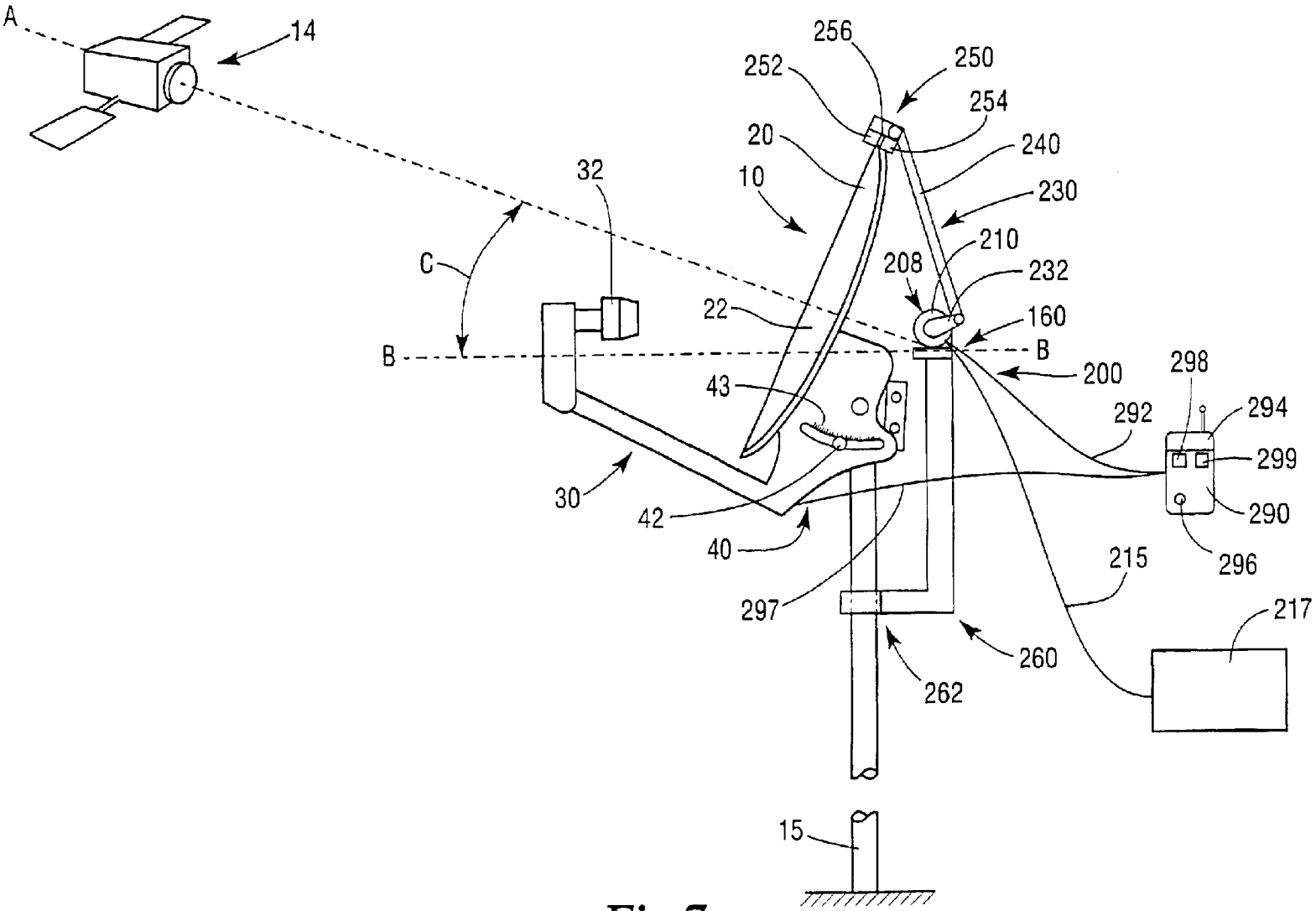
FIG. 7 is a side elevational view of another embodiment of the antenna alignment device of the present invention attached to a conventional antenna that is mounted to a mast to receive a signal from a satellite.
Figure 7A:
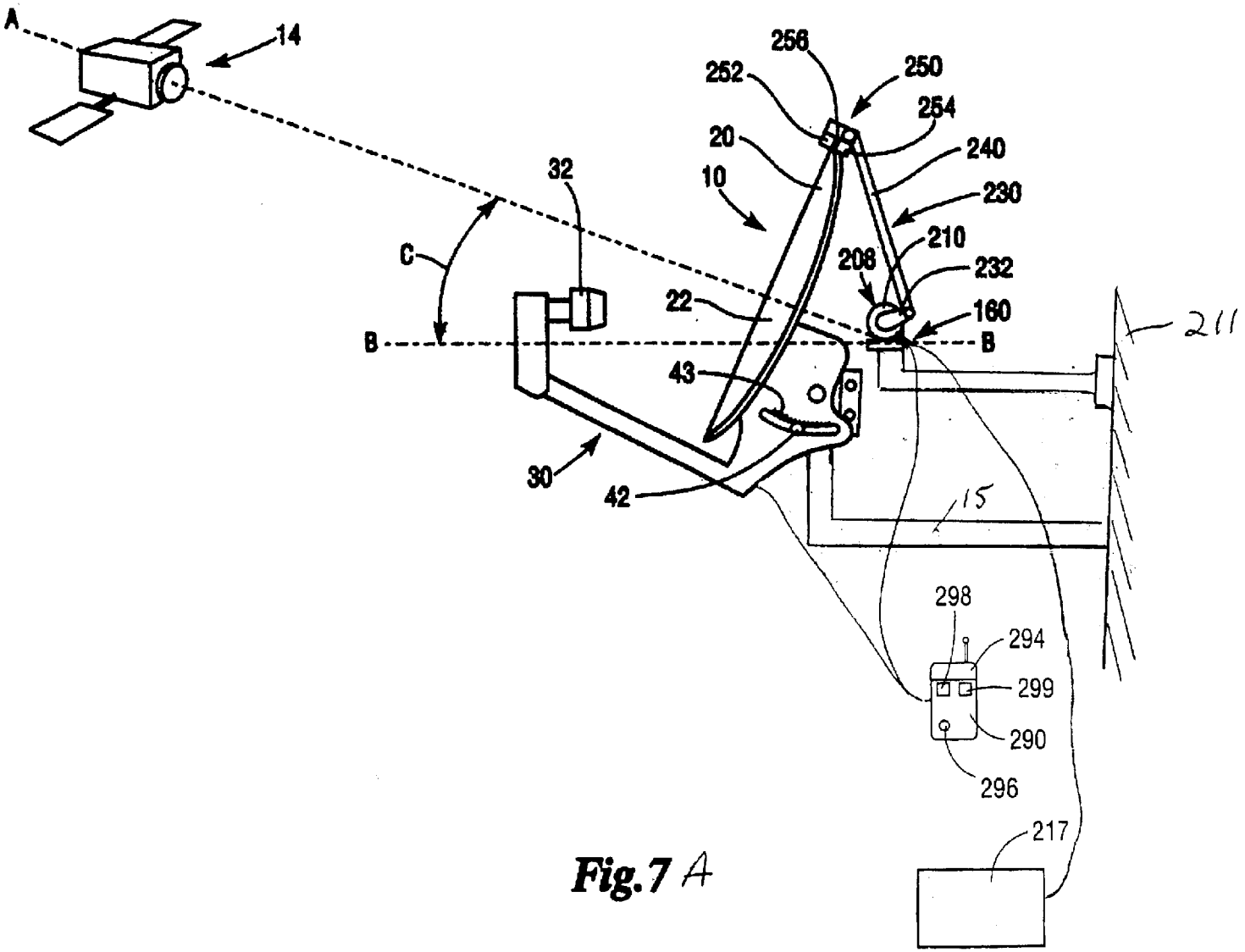
FIG. 7A is a side elevational view of another embodiment of the antenna alignment device of the present invention attached to a conventional antenna that is mounted to a mast to receive a signal from a satellite.
Figure 7B:
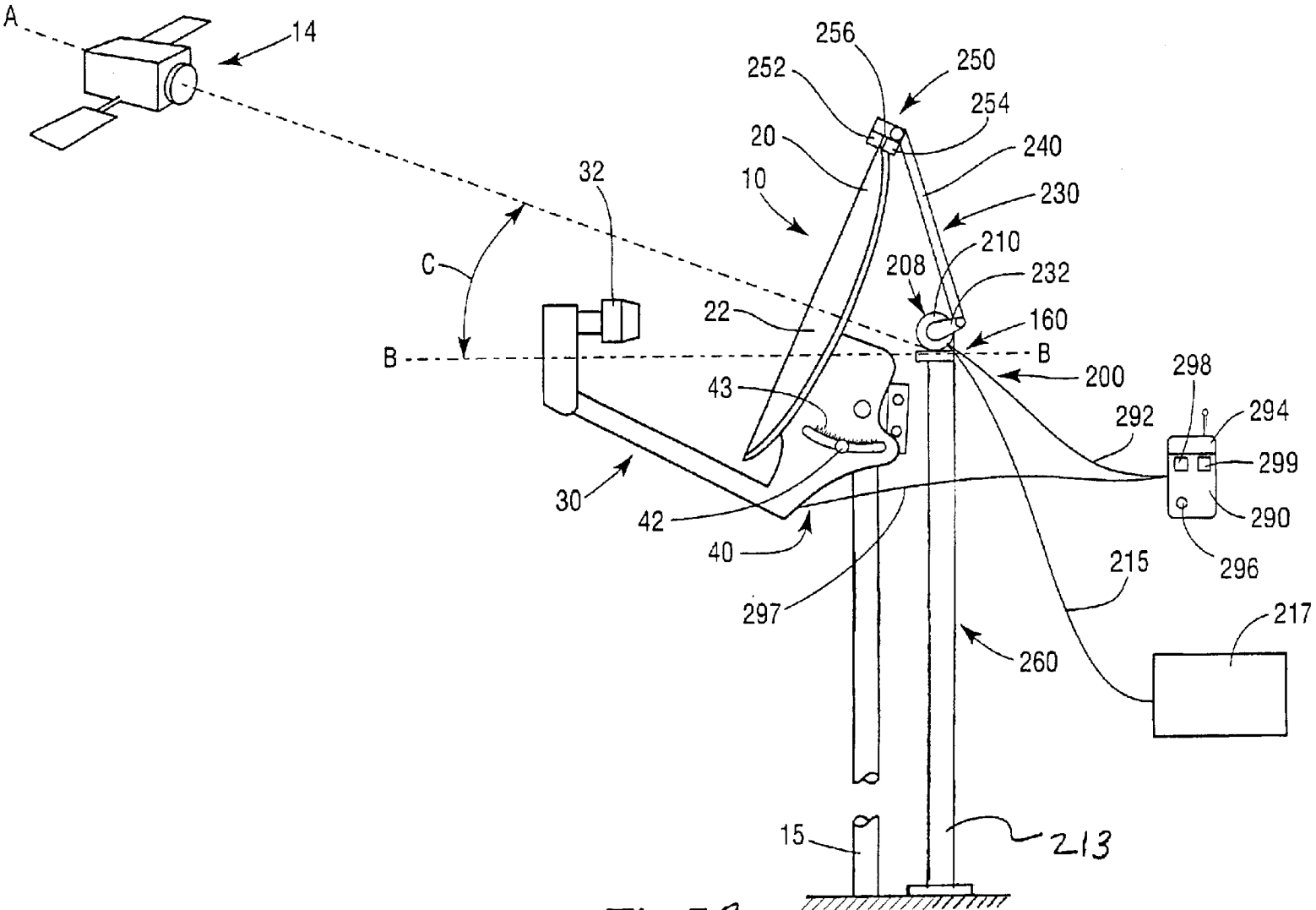
FIG. 7B is a side elevational view of another embodiment of the antenna alignment device of the present invention attached to a conventional antenna that is mounted to a mast to receive a signal from a satellite.
Figure 8:
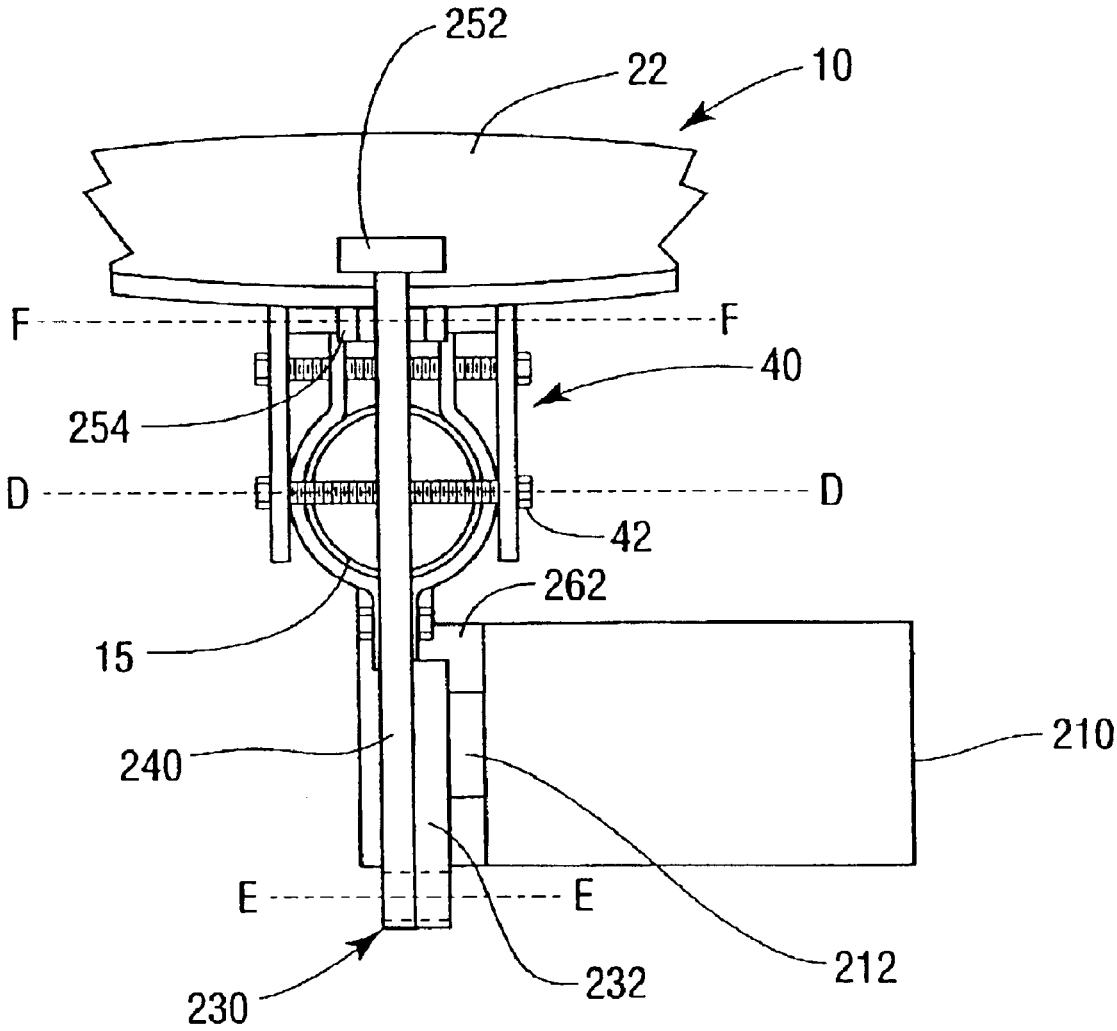
FIG. 8 is a top of view of the antenna alignment device and antenna depicted in FIG. 7.

FIGS. 7 and 8 depict another embodiment of the present invention. In that embodiment, a portable device 200 for orienting a receiver 10 that is supported on a mast 15 by a mounting bracket assembly 40 of the type described above or a similar arrangement is provided to orient the receiver at a desired elevation angle about elevation pivot axis D—D. See FIG. 8. Those elements that are common with the embodiments described above are identified with the same element numbers. In this embodiment, an elevation actuator 208 that, in this embodiment, comprises a conventional stepper motor 210 is employed. The motor 210 may be removably coupled to the mast 15 by a support bracket assembly 260 that is fastened (i.e., clamped, welded screwed, etc.) to the motor 210 and that has a clamp assembly 262 in the form of a split ring or other appropriate arrangement to removably couple the support bracket assembly 262 to the mast 15. While the support bracket assembly 262 of this embodiment is fastened to the motor 210 and clamped to the mast 15, those of ordinary skill in the art will appreciate that other arrangements for supporting the motor 210 may be employed. For example, the motor 210 could be removably coupled to an adjacent structure 211, instead of being coupled to the support mast 15. See FIG. 7A. It is also conceivable that the motor 210 may be supported on its own freestanding structure 213. See FIG. 7B. These alternatives are merely illustrative of the various alterations that may be employed by one of ordinary skill in the art without departing from the spirit and scope of the present invention and are not exhaustive of all of such variations that may conceivably be employed.

In the embodiment depicted in FIGS. 7 and 8, the motor 210 is a conventional electric stepper motor that receives AC power through a cable 215 that is coupled to a source of AC power generally designated as 217. However, it is conceivable that motor 210 may comprise a DC powered stepper motor that is powered by a battery or batteries. Motor 210 has a driven output shaft 212 which is attached to a linkage assembly, generally designated as 230. In the embodiment, the linkage assembly 230 includes a first link member 232 that is attached to the driven shaft 212 by, for example, threads, sets screws, a detachable collar, welds, etc. Also in this embodiment, a second link member 240 is pivotally coupled to the first link member 230 such that it may pivot about pivot axis E—E. Attached to another end of the second link member 240 is a clamp assembly 250 that has two retainer arms (252, 254) that define a retention area 256 therebetween for receiving a portion of the receiver 10 therein. In the embodiment depicted in FIGS. 7 and 8, retainer arms (252, 254) are fixed relative to each other and are so configured so that they may receive a portion of the edge of the receiver 10 therebetween. In another embodiment, not shown, the retainer arms (252, 254) may be adjustable relative to each other to accommodate different receiver configurations. The clamping assembly 250 may be fabricated from, for example, aluminum with a rubberized clamping surface or other materials that will not damage the receiver. Clamping assembly 250 may be pivotally attached to the second link member for pivotal travel relative thereto about a pivot axis "F—F".

By controlling the operation of the motor 210, the linkage assembly 230 causes the receiver to pivot about the elevation pivot axis D—D to a desired elevation angle "C". To use this embodiment, the user clamps the mounting bracket 260 to the mast 15 and the clamping assembly 250 onto a portion of the receiver 10 as shown in FIG. 7. The user loosens elevation adjustment bolt 42 of the mounting bracket 40 to permit the receiver 10 to pivot about elevation pivot axis D—D. After the adjustment bolt 42 has been loosened to permit the receiver 10 to pivot about elevation pivot axis D—D, the motor 210 is powered to cause the receiver 10 to pivot about elevation pivot axis D—D until it is oriented at a desired elevation angle "C". Thereafter, the mounting bracket 40 may be locked in that position, (i.e., the elevation adjustment bolt 42 is secured to prevent and further pivotal travel about the elevation pivot axis D—D). After the mounting bracket 40 has been locked to prevent further pivotal travel of the receiver 10 about the elevation pivot axis D—D, the support bracket 260 may be detached from the mast 15 and the clamp assembly 250 is removed from the receiver 10 to permit the device 200 to be used in connection with other receiver installations.

When using the device 200 as described above, the user may simply keep checking the elevation angle "C" of the receiver 10 using other known methods and apparatuses or, in another embodiment, the motor 210 may be controlled by a controller 290 as shown in FIG. 7. The controller 290 may be portable and, if desired, handheld and powered by a DC battery or batteries and coupled to the motor 210 by a cable 292. The desired elevation angle "C" is determined by the latitude and longitude of the antenna and the particular satellite 14 of interest. In this embodiment, the controller 290 may be equipped with commercially available software that generates appropriate control output signals, such as signals for controlling motor 210. One type of commercially available software that could conceivably be employed is that software sold under the trademark SATMASTER by Arrow Technical Services of 58 Forest Road, Heswall Wirral, CH60 5SW, England. However, other commercially available software packages could also be successfully used.

To use the controller 290, the user inputs the latitude and longitude of the receiver 10 and the appropriate information concerning the particular satellite 14 with which the receiver 10 is to be aligned and the software program is executed to cause the controller 290 to generate appropriate control output signals for controlling the motor 210 such that the motor 210 operates to pivot the receiver 10 to the desired elevation angle "C". Thereafter, the mounting bracket 40 may then be locked to prevent further pivotal travel of the receiver 10 about the elevation pivot axis D—D and the device 200 may then be removed to enable it to be used with other receiver installations. The controller 290 may be equipped with a conventional global positioning system 294 and/or compass 296 to enable the user to determine the longitude and latitude of the receiver 10. Also, the controller 290 maybe coupled to the LNBF 32 by a cable 297 to enable the controller 290 to assess the signal strength and provide further appropriate control output signals to the motor 210 until the receiver 10 is oriented at the desired elevation angle. When using this alternative, the controller 290 may be equipped with a visual indicator 298 and/or an audio indicator 299 to provide the user with an indication that the receiver 10 has been oriented in an orientation that provides a desired amount of signal strength. After the receiver 10 has been oriented in the desired orientation, the mounting bracket 40 may then be locked in position and the device 200 may be removed therefrom.

Figure 9:
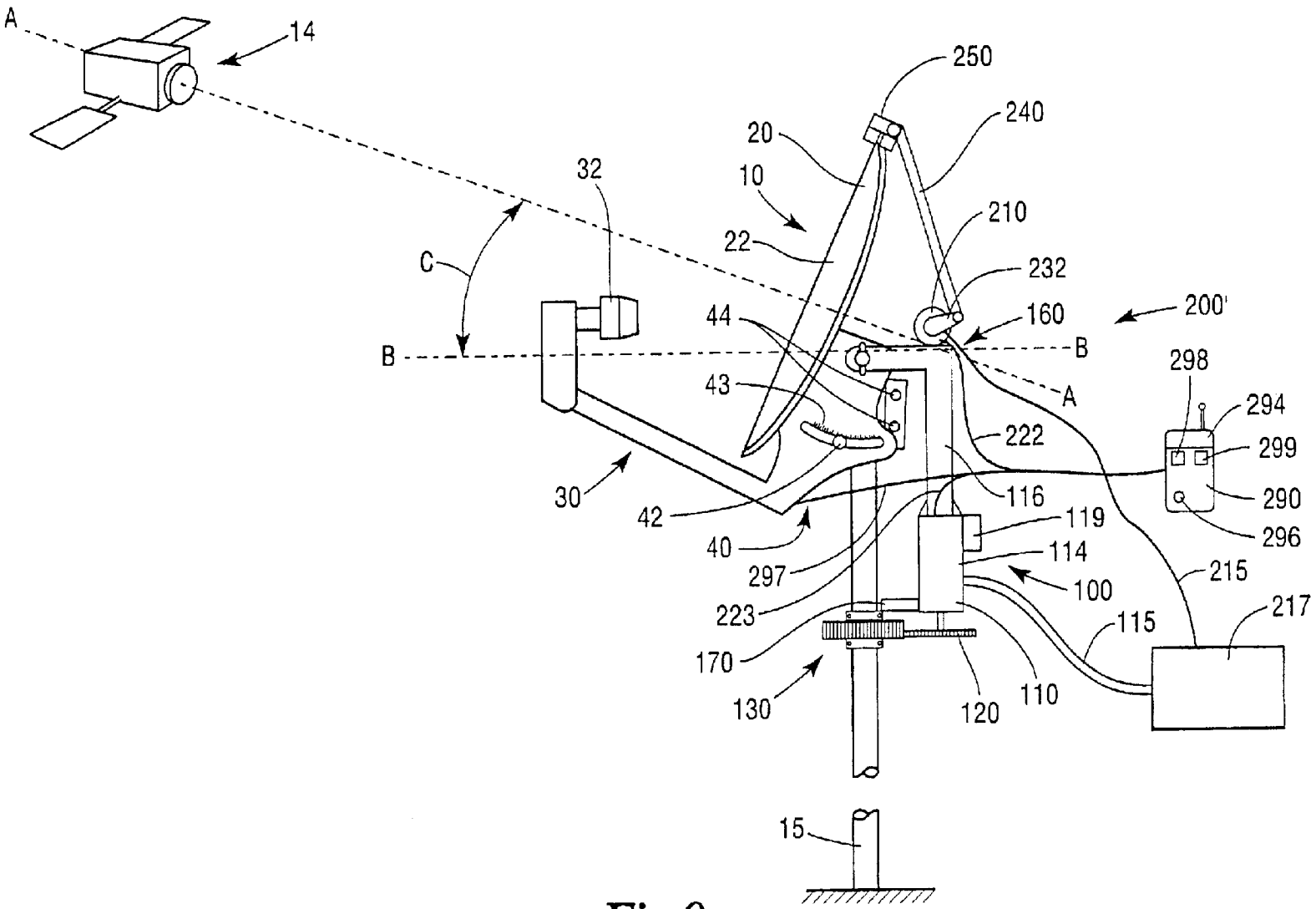
FIG. 9 is a side elevational view of another embodiment of the antenna alignment device of the present invention attached to a conventional antenna that is mounted to a mast to receive a signal from a satellite.
Figure 10:
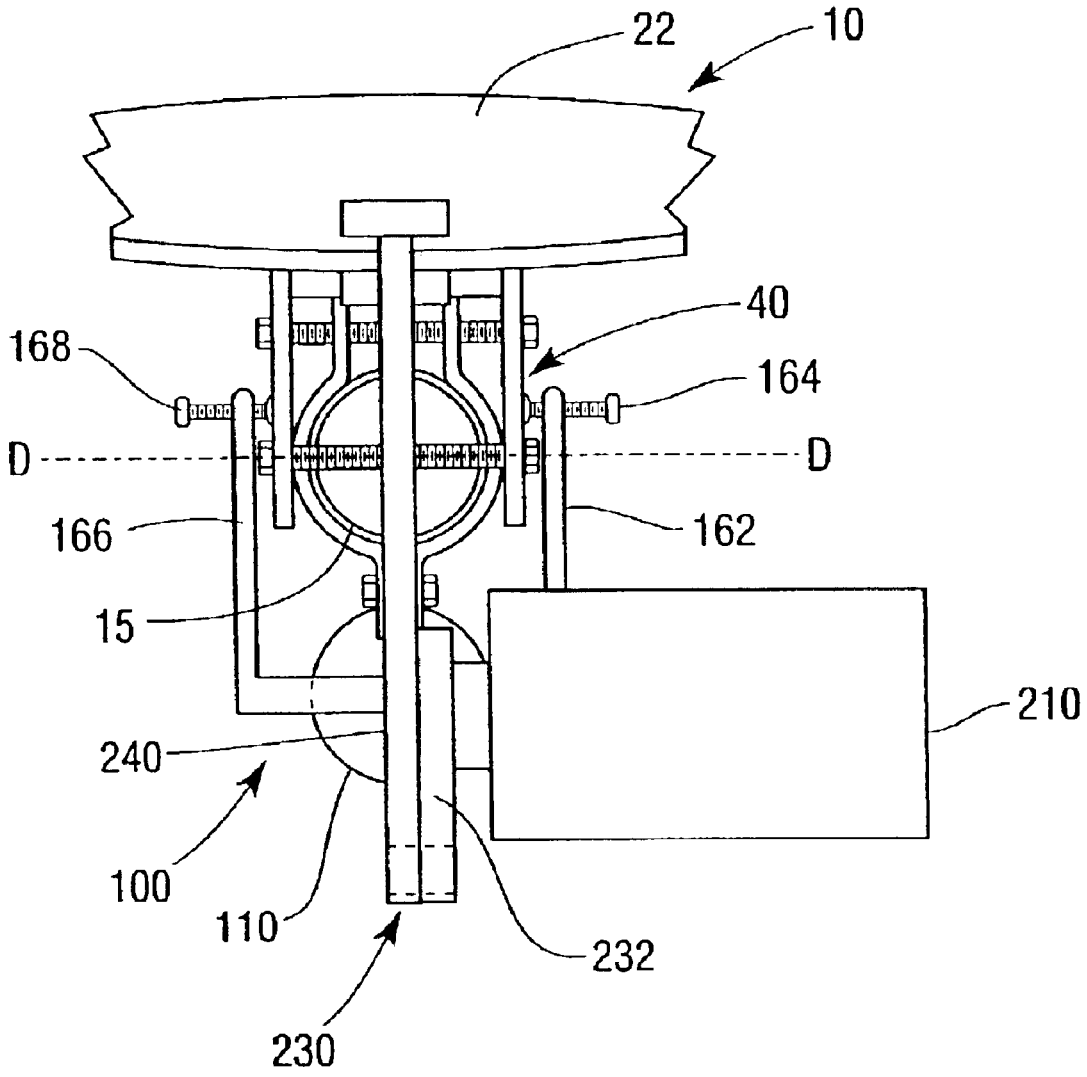
FIG. 10 is a top of view of the antenna alignment device and antenna depicted in FIG. 9.

FIGS. 9 and 10 depict another embodiment of the present invention. In that embodiment, the "first" motor 110 and the "second" motor 210 are employed to orient the antenna in the desired azimuth and elevation orientation as described above. Unless otherwise stated the components of this embodiment operate in the manners described above. However, in this embodiment, the mounting bracket 160 is constructed to also support the second motor 210. Also, the first motor 110 and the second motor 210 are combined coupled to the controller 290 by cables (222, 223), respectively such that the controller 290 may be used to actuate the motors (110, 210) to orient the receiver 10 in the desired azimuth and elevation orientations as described above.

To use the device 200', the user couples the clamping assembly 160 onto the mounting bracket assembly 40 by turning the first and second clamping screws (164, 168) into clamping engagement with the mounting bracket assembly 40. Thereafter, the gear assembly 130 is clamped onto the mast 15 with the clamping screws (145, 149) as described above and is arranged in meshing engagement with gear 120. The clamping assembly 250 is placed into retaining engagement with a portion of the receiver 10 as described above. The user then couples the controller 290 to the LNBF with cable 297. In addition, the controller 290 is coupled to the first motor 110 with a cable 222 and the second motor 210 is coupled to the controller 290 with cable 223.

After the alignment device 200' is affixed to the mast 15 and mounting bracket assembly 40 as shown in FIGS. 9 and 10, the elevation locking bolts 42 and the azimuth locking bolts 44 on the mounting bracket assembly 40 are loosened. The user then enters the latitude and longitude of the receiver 10 and the appropriate information concerning the particular satellite 14 with which the receiver 10 is to be aligned and the software program is executed to cause the controller 290 to generate appropriate control output signals for controlling the motors (110, 210) such that the first motor 110 operates to pivot the receiver 10 to the desired azimuth setting and the second motor 210 operates to pivot the receiver 10 to the desired elevation angle. Thereafter, the locking bolts (42, 44) may be secured to prevent further pivotal travel of the receiver 10. The device 200' may then be removed to enable it to be used with other receiver installations.

As was discussed above, the controller of this embodiment may be equipped with a conventional global positioning system 294 and/or conventional compass 296 to enable the user to determine the longitude and latitude of the receiver 10. Also, the controller 290 may be coupled to the LNBF 32 by a cable 297 to enable the controller 290 to assess the signal strength and provide further appropriate outputs to the motors (110, 210) such that the receiver 10 is oriented at the desired azimuth setting and elevation angle. When using this alternative, the controller 290 may be equipped with a visual indicator 298 and/or an audio indicator 299 to provide the user with an indication that the receiver 10 has been oriented in an orientation that provides a desired amount of signal strength. After the receiver 10 has been oriented in the desired orientation, the mounting bracket 40 may be locked in position and the device 200' is removed therefrom. The reader will appreciate that the first motor 110 and the second motor 210 may be so activated such that the receiver 10 may be oriented in the desired elevation angle prior to being oriented at the desired azimuth orientation or visa versa. Furthermore, the first motor 110 and the second motor 210 may be simultaneously activated and controlled such that the receiver 10 may be simultaneously positioned in the desired elevation angle and azimuth orientation.

The embodiments of the present invention have been described herein for use in connection with a conventional receiver such as an antenna of the type depicted in FIGS. 1, 7, and 9. The skilled artisan will readily appreciate, however, that these embodiments of the present invention could be successfully employed with a myriad of other types of receivers, antennas and antenna mounting bracket configurations without departing from the spirit and scope of the present invention. Thus, the scope of protection afford to these embodiments of the present invention should not be limited to use in connection with the specific type of antenna depicted in the Figures.

The embodiments of the present invention represent a vast improvement over prior motorized antenna alignment devices. Due to its portable nature, the present invention is well-suited for use by installers that typically install and orient several antennas. The various embodiments of the present invention may be quickly attached to an existing antenna installation to orient the antenna in a desired elevation angle or elevation angle and azimuth orientation and thereafter be removed from the antenna for use in connection with another antenna that differs from the first antenna. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A method of orienting an antenna, comprising:

coupling an orientation device to the antenna;

assessing a signal strength of a satellite signal received by the antenna;

actuating the orientation device to orient the antenna in a desired orientation wherein the assessed signal strength is equivalent to a desired signal strength;

retaining the antenna in the desired orientation; and decoupling the orientation device from the antenna.

2. The method of claim 1 wherein said actuating the orientation device comprises actuating the orientation device to move the antenna to a desired elevation orientation and a desired azimuth orientation.

3. The method of claim 1, further comprising providing an indicator when the assessed signal strength is equivalent to the desired signal strength.

4. The method of claim 3 wherein said providing an indicator comprises providing a visual indicator.

5. The method of claim 3 wherein said providing an indicator comprises providing an audio indicator.

6. The method of claim 3 wherein said providing an indicator comprises providing an audio indicator and a visual indicator.

7. A method of aligning an antenna with a satellite, the method comprising:

coupling an orientation device to the antenna for adjusting the antenna to an elevation angle and azimuth orientation;

assessing a signal strength of a satellite signal received by the antenna;

actuating the orientation device to position the antenna in an elevation position and an azimuth position which result in a desired signal strength;

providing an indicator when the desired signal strength is achieved;

retaining the antenna in the elevation an azimuth positions which result in the desired signal strength; and decoupling the orientation device from the antenna.

8. The method of claim 7 wherein said providing an indicator comprises providing an audio indicator when the desired signal strength is achieved.

9. The method of claim 7 wherein said providing an indicator comprises providing a visual indicator when the desired signal strength is achieved.

10. The method of claim 7 wherein said providing an indicator comprises providing a visual indicator and an audio indicator when the desired signal strength is achieved.

* * * * *